US009079110B2

(12) United States Patent
Byrne et al.

(10) Patent No.: US 9,079,110 B2
(45) Date of Patent: Jul. 14, 2015

(54) CHILDREN'S RIDING TOY HAVING ELECTRONIC SOUND EFFECTS

(71) Applicant: Radio Flyer Inc., Chicago, IL (US)

(72) Inventors: Emily Byrne, Chicago, IL (US); Thomas Schlegel, Wheaton, IL (US); Mark Johnson, Cary, IL (US); Katherine Powers, Chicago, IL (US)

(73) Assignee: Radio Flyer Inc., Chicago, IL (US)

( * ) Notice: Subject to any disclaimer, the term of this patent is extended or adjusted under 35 U.S.C. 154(b) by 0 days.

(21) Appl. No.: 14/021,627

(22) Filed: Sep. 9, 2013

(65) Prior Publication Data

US 2014/0011601 A1 Jan. 9, 2014

Related U.S. Application Data

(63) Continuation of application No. 13/018,774, filed on Feb. 1, 2011, now Pat. No. 8,529,310.

(60) Provisional application No. 61/300,640, filed on Feb. 2, 2010.

(51) Int. Cl.
*A63G 13/06* (2006.01)
*A63H 3/48* (2006.01)

(52) U.S. Cl.
CPC ..... *A63G 13/06* (2013.01)

(58) Field of Classification Search
CPC ..... A63G 1/30; A63G 13/00; A63G 13/06; A63G 17/00; A63H 3/48; A63H 5/00; A63H 17/28; A63H 33/00; A63H 33/28; A63B 69/00; A63B 69/04; A63B 2071/0625
USPC ..... 472/95–105, 118, 119, 135; 434/55, 434/361; 446/29, 175, 297, 484
See application file for complete search history.

(56) References Cited

U.S. PATENT DOCUMENTS

| | | | |
|---|---|---|---|
| 190,978 | A | 5/1877 | Pflum |
| 430,152 | A | 6/1890 | Snyder |
| 1,372,351 | A | 3/1921 | Hurlstone-Jones |
| 2,176,832 | A | 3/1936 | Allen |
| 2,382,630 | A | 12/1944 | Gumb |
| 2,519,489 | A | 8/1950 | McDevitt |
| 2,578,682 | A | 12/1951 | Fernstrom |

(Continued)

*Primary Examiner* — Kien Nguyen
(74) *Attorney, Agent, or Firm* — McDermott Will & Emery LLP

(57) ABSTRACT

A riding toy includes a body with a spring assembly supporting the body on a base so that the body may be moved in first and second motions with respect to the base. The riding toy also includes a microcontroller and first and second motion sensors responsive to the first and second motions, respectively. The first and second motion sensors are positioned on the body and in electronic communication with the microcontroller. A sound synthesizing circuit is in electronic communication with the microcontroller and a speaker. The microcontroller is programmed to provide a first sound effect when the first motion sensor detects the first motion and a second sound effect when the second sensor detects the second motion. The first sound effect is varied based on a speed of the first motion and preempts the second sound effect if both the first and second motions are taking place simultaneously. The riding toy also includes a light sensor in electronic communication with the microprocessor. The microprocessor activates the sound synthesizing circuit to produce a third sound effect when the light sensor is triggered.

18 Claims, 5 Drawing Sheets

(56) References Cited

U.S. PATENT DOCUMENTS

| | | | | |
|---|---|---|---|---|
| 2,648,160 | A | | 8/1953 | Van Voorhis |
| 2,740,636 | A | | 4/1956 | Dix |
| 2,882,050 | A | | 4/1959 | Deady |
| 2,915,312 | A | | 12/1959 | Barthel |
| 2,921,789 | A | | 1/1960 | Skinner, Sr. |
| 2,940,755 | A | | 6/1960 | Pouder |
| 3,055,672 | A | | 9/1962 | Parks |
| 3,090,618 | A | | 5/1963 | Brent |
| 4,121,373 | A | | 10/1978 | Slowe et al. |
| 4,157,826 | A | | 6/1979 | Sims et al. |
| 4,245,425 | A | | 1/1981 | D'Andrade |
| 4,289,307 | A | | 9/1981 | Marshall, Jr. et al. |
| 5,045,016 | A | | 9/1991 | Stern et al. |
| 5,074,820 | A | | 12/1991 | Nakayama |
| 5,316,515 | A | | 5/1994 | Hyman et al. |
| 5,324,225 | A | | 6/1994 | Satoh et al. |
| 5,356,329 | A | | 10/1994 | Thornell |
| 5,421,763 | A | | 6/1995 | Amburgey et al. |
| 5,429,515 | A | | 7/1995 | Greenwood |
| 5,533,899 | A | | 7/1996 | Young |
| 5,791,965 | A | | 8/1998 | Kim |
| 5,961,195 | A | * | 10/1999 | Yoshimatsu et al. ..... 353/98 |
| 6,150,947 | A | | 11/2000 | Shima |
| 6,210,167 | B1 | | 4/2001 | Nishiyama |
| 6,210,286 | B1 | * | 4/2001 | Ohara et al. ..... 472/97 |
| 6,412,787 | B1 | | 7/2002 | Pardi et al. |
| 6,416,381 | B1 | | 7/2002 | Walter et al. |
| 6,524,156 | B1 | | 2/2003 | Horchler et al. |
| 6,780,076 | B2 | | 8/2004 | Horchler et al. |
| 6,881,118 | B2 | | 4/2005 | Klick, Jr. |
| 7,300,328 | B2 | | 11/2007 | Klick, Jr. |
| 7,311,578 | B2 | | 12/2007 | Stanley et al. |
| 7,341,499 | B2 | | 3/2008 | Wizenberg et al. |
| 7,402,111 | B2 | | 7/2008 | Michelau et al. |
| 7,775,893 | B2 | | 8/2010 | Blumenthal |
| 7,780,500 | B2 | | 8/2010 | Sonner et al. |
| 7,938,218 | B2 | | 5/2011 | Howell et al. |
| 7,988,522 | B2 | | 8/2011 | Chen |
| 8,047,925 | B2 | | 11/2011 | Burgaard et al. |
| 8,529,310 | B2 | | 9/2013 | Powers et al. |
| 2002/0163141 | A1 | | 11/2002 | Pardi et al. |
| 2005/0181699 | A1 | | 8/2005 | Klick, Jr. |
| 2007/0287139 | A1 | | 12/2007 | Holm |

* cited by examiner

CHILDREN'S RIDING TOY HAVING ELECTRONIC SOUND EFFECTS

CROSS-REFERENCE TO RELATED APPLICATIONS

This application claims the benefit of U.S. Provisional Patent Application No. 61/300,640, filed Feb. 2, 2010, and U.S. Utility patent application Ser. No. 13/018,744, filed on Feb. 1, 2011, both of which are incorporated herein by reference in their entirety and made a part hereof.

FEDERALLY SPONSORED RESEARCH OR DEVELOPMENT

Not Applicable.

TECHNICAL FIELD

The present invention relates to riding toys for children and, more particularly, to a riding toy that provides multiple interactive play features and corresponding sound effects.

BACKGROUND OF THE INVENTION

Riding toys, including, but not limited to, spring horses, have long been popular with children. Such toys provide a child with enjoyment and exercise. Parents also appreciate such toys as they motivate a child to engage in physical activity or play.

Interactive electronic features that provide sounds have been added to riding toys to make them more entertaining for children. Such toys, for example, may produce sounds when the child presses a button or the like. In addition, toys that produce sounds automatically when ridden are known. An example of such a toy is provided in U.S. Pat. No. 6,416,381 to Walter et al.

A need exists, however, for a riding toy that provides multiple interactive play features, each with its own corresponding sound. Such a riding toy would hold a child's interest more and receive more play time by providing multiple sounds in response to the child's operation of the interactive play features so as to activate the multiple sound effects.

BRIEF DESCRIPTION OF THE DRAWINGS

To understand the present invention, it will now be described by way of example only, not by way of limitation, with reference to the accompanying drawings in which.

DETAILED DESCRIPTION

Figure 1:
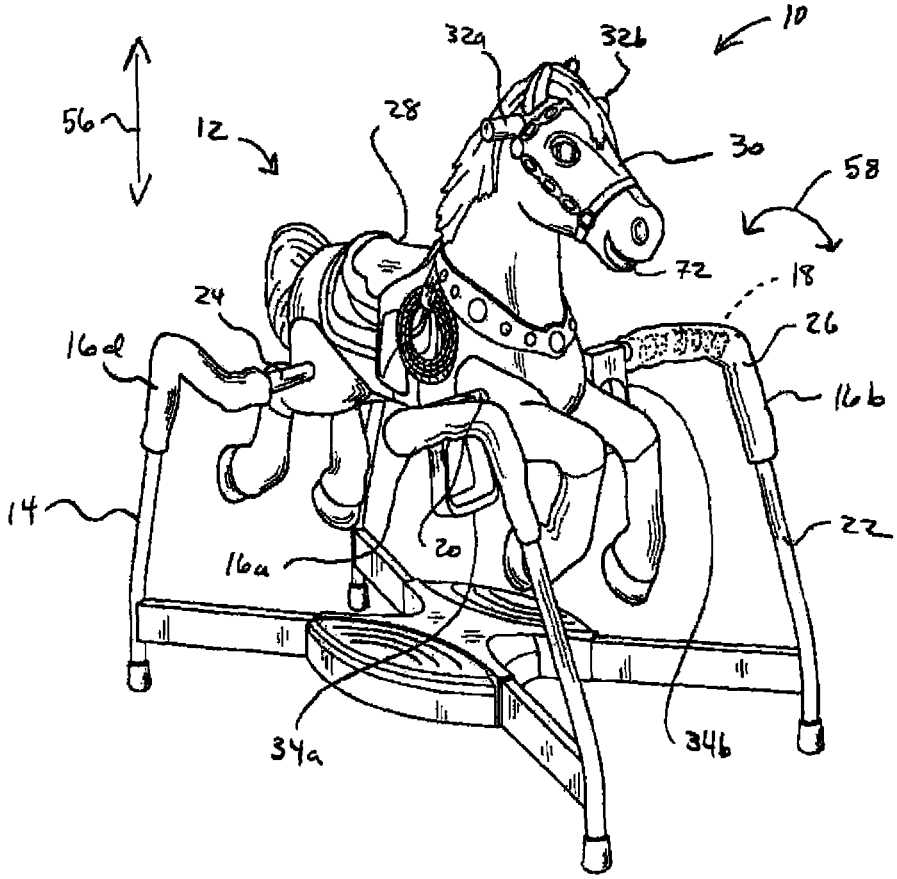
FIG. 1 is a perspective view of an embodiment of the children's riding toy of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

An embodiment of the children's riding toy of the present invention is indicated in general at 10 in FIG. 1. While the children's riding toy is illustrated as a spring horse, it is to be understood that the children's riding toy of the present invention could take the form of alternative types of riding toys.

As illustrated in FIG. 1, the riding toy features a body, indicated in general at 12, which is mounted to a base 14 via spring assemblies 16*a*-16*d* (with spring assembly 16*c* located behind the horse body 12 in FIG. 1 and therefore not visible).

As illustrated for spring assembly 16*b*, each spring assembly preferably includes a resilient member in the form of a tension coil spring, illustrated in phantom at 18, having one end attached to the horse body via front support rod 20, which passes through the body 12 of the horse. The opposite end of the coil spring 18 is attached to the top end of corner post 22 of the base 14. A rear support rod 24 also passes through the horse body 12 and is connected to the spring assemblies 16*c* and 16*d*. A protective sleeve 24 covers the coil spring 18 of spring assembly 16*b*. The remaining spring assemblies 16*a*, 16*c* and 16*d* feature a similar construction. The connections of the spring assemblies, and the spring assemblies themselves, preferably take the form of those illustrated in commonly assigned U.S. Pat. No. 7,402,111 to Michelau et al., the contents of which are hereby incorporated by reference. The spring assemblies are each also preferably provided with a safety strap (not shown) made from woven fabric or the like. The safety straps are connected between each frame corner post and the front and rear support rods of the horse body.

The body 12 is preferably constructed from molded plastic, while the base 14 is preferably constructed from steel. The body preferably features a seat 28 upon which a child may sit, as well as a head 30 featuring handles 32*a* and 32*b*, which a child may grip with his or her hands while riding the spring horse. The horse also features foot rests for the child rider in the form of stirrups 34*a* and 34*b*.

Figure 2:
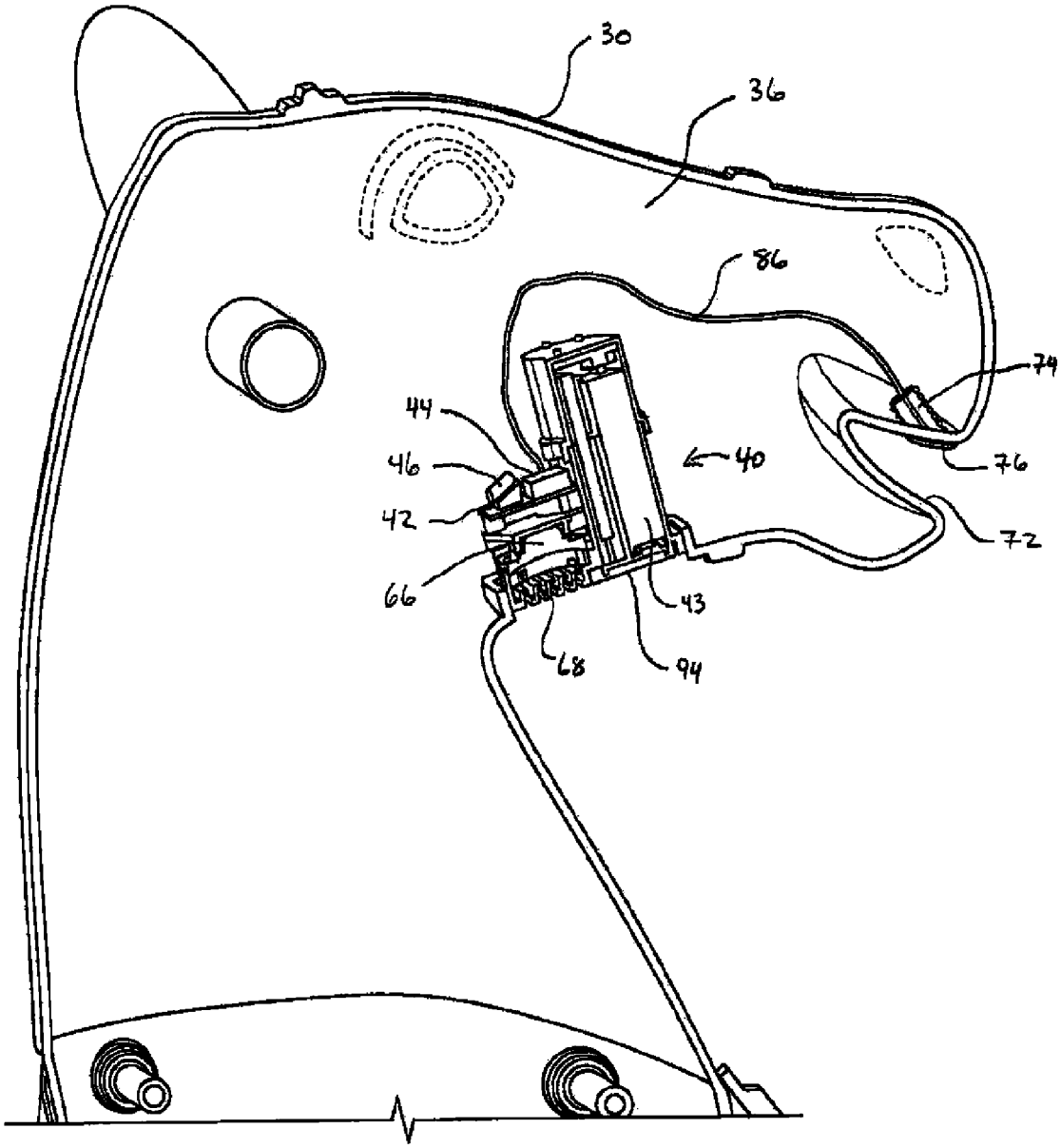
FIG. 2 cross sectional view of the head portion and the electronic components of the children's riding toy of FIG. 1.
Figure 3:
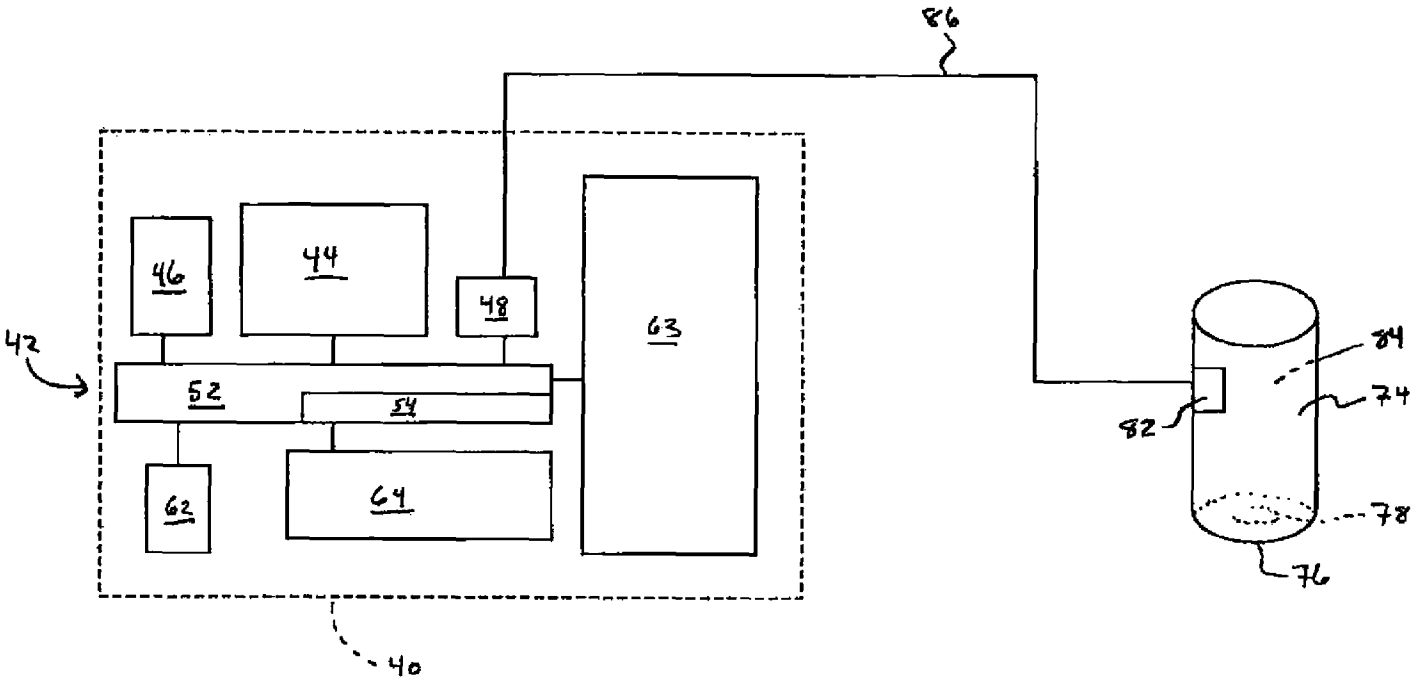
FIG. 3 is a schematic diagram of the electronic components of FIG. 2.

As illustrated in FIG. 2, the head portion 30 of the horse body of FIG. 1 is hollow so as to define a chamber 36. Positioned within the chamber is an electronics module, indicated in general at 40. As illustrated in FIGS. 2 and 3, the electronics module 40 features an integrated circuit (IC) chip 42, as well as a battery compartment 43 for holding batteries to power the electronics module. Any programmable electronic device may be substituted for the IC chip 42.

As illustrated in FIG. 3, the electronics module further includes a first or main motion sensor 44, a second or auxiliary motion sensor 46 and a sensor connector 48. The IC chip 42 includes a microcontroller 52 and a sound synthesizing circuit 54. In the illustrated embodiment, the second or auxiliary motion sensor 46 takes the form of a ball sensor, such as is available from Shenzhen Linyuan Hardware Spring Factory of Guangdong, China, that is oriented to produce signals corresponding to up and down or bouncing movement, illustrated by arrows 56 of FIG. 1, of the horse body. The first or main motion sensor 44 may be any type of commercially known motion switch or sensor, such as is available from Mobicon Holdings Ltd. of Hong Kong, that detects fore and aft or rocking movement, illustrated by arrows 58 of FIG. 1, of the horse body. The main motion sensor 44, ball sensor 46 and connector 48 all electronically communicate with the microcontroller 52 of the IC chip 42.

As illustrated in FIG. 3, the electronics module also includes a power switch 62, batteries 63 and a speaker 64. The power switch 62 turns the electronics module on and off and the speaker communicates electronically with the sound synthesizing circuit 54. With reference to FIG. 2, the electronics module includes a speaker compartment 66 that houses the speaker 64 of FIG. 3 and includes a grating 68 that permits sound from the speaker to exit the speaker compartment. The batteries 63 of FIG. 3 are housed in the electronics module battery compartment 43 of FIG. 2.

Housing the electronics module within the chamber 36 defined within the horse body protects the electronic components of the electronics module from damage.

As illustrated in FIGS. 1 and 2, the head portion 30 of the horse features a simulated mouth 72. A light sensor tube 74 is positioned within the chamber 36 of the horse head 30 so as to be positioned adjacent to the simulated mouth 72. As illustrated in FIGS. 2 and 4A, the light sensor tube 74 features a bottom 76 having an opening 78 positioned within the simulated mouth. As illustrated in FIG. 3, a light sensor 82 is positioned within the interior 84. While any commercially known light sensor may be used as light sensor 82, suitable light sensors are available from, for example, Coleman Electronics Co., Ltd. of Guangdong, China. Light sensor tube 74 preferably is constructed of plastic and may feature either a closed or open top (since it is exposed to the dark interior chamber 36 of the horse body head portion). As will be explained in greater detail below, the light sensor interacts with the microcontroller and other components of the electronics module to provide chewing and eating sound effects when a simulated food item, such as toy carrot 85 of FIG. 4A, is placed in the simulated mouth 72 of the horse.

As illustrated in FIGS. 2 and 3, light sensor 82 communicates electronically with the IC chip 42 of the electronics module 40 via wire 86. The wire 86 preferably connects to the IP chip 42 via a connector 48 so that the light sensor 82 and electronics module 40 may be disconnected from one another for removal and repair or replacement of the electronics module.

Figure 4B:
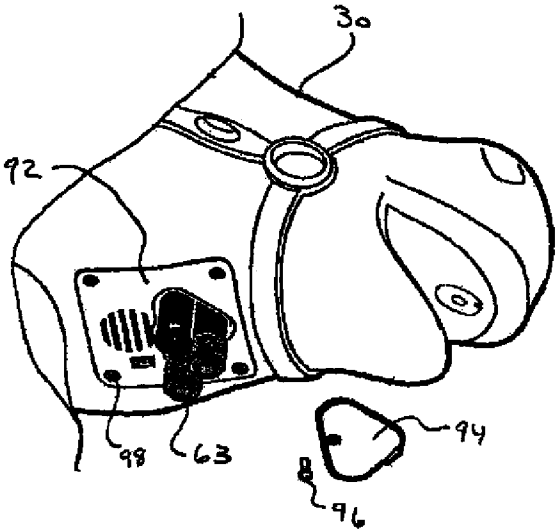
FIGS. 4A and 4B are partial perspective views of the underside of the head portion of the children's riding toy of FIG. 1 illustrating the bottom panel of the electronics module of FIGS. 2 and 3 and access to the battery compartment and power switch.
Figure 4A:
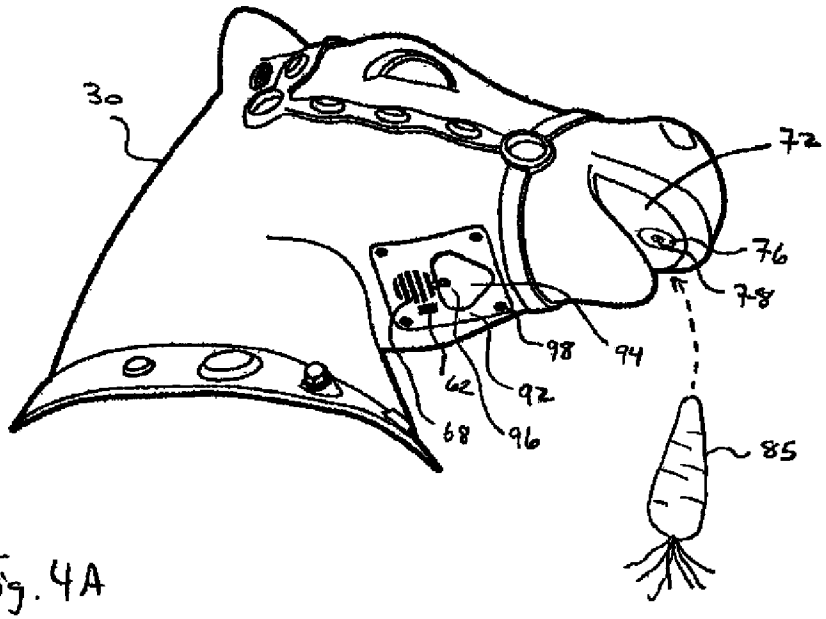

As illustrated in FIGS. 4A and 4B, the bottom panel 92 of the electronics module 40 features the speaker compartment grating 68, power switch 62 and a battery compartment cover 94 (which provides access to electronics module battery compartment 43 of FIG. 2). The battery compartment cover 94 is preferably secured to the electronics module bottom panel 92 in a removable fashion via a fastener such as screw 96. As a result, as illustrated in FIG. 4B, the battery compartment cover 94 may be removed so that the batteries 63 of the electronics module may be replaced. Furthermore, the bottom panel 92 of the electronics module preferably attaches to the horse head portion 30 via fasteners such as screws 98 so that the electronics module may be easily removed as a unit for repair or replacement.

Operation of the electronics of the children's riding toy of FIGS. 1-4B will now be explained with reference to FIG. 5, which shows the logic performed by the microcontroller 52 of FIG. 3. As indicated by block 102 of FIG. 5, a user must first turn the electronics module on via power switch 62 of FIG. 3 for the riding toy to provide sound effects in response to the user's interaction with the toy.

Figure 5:
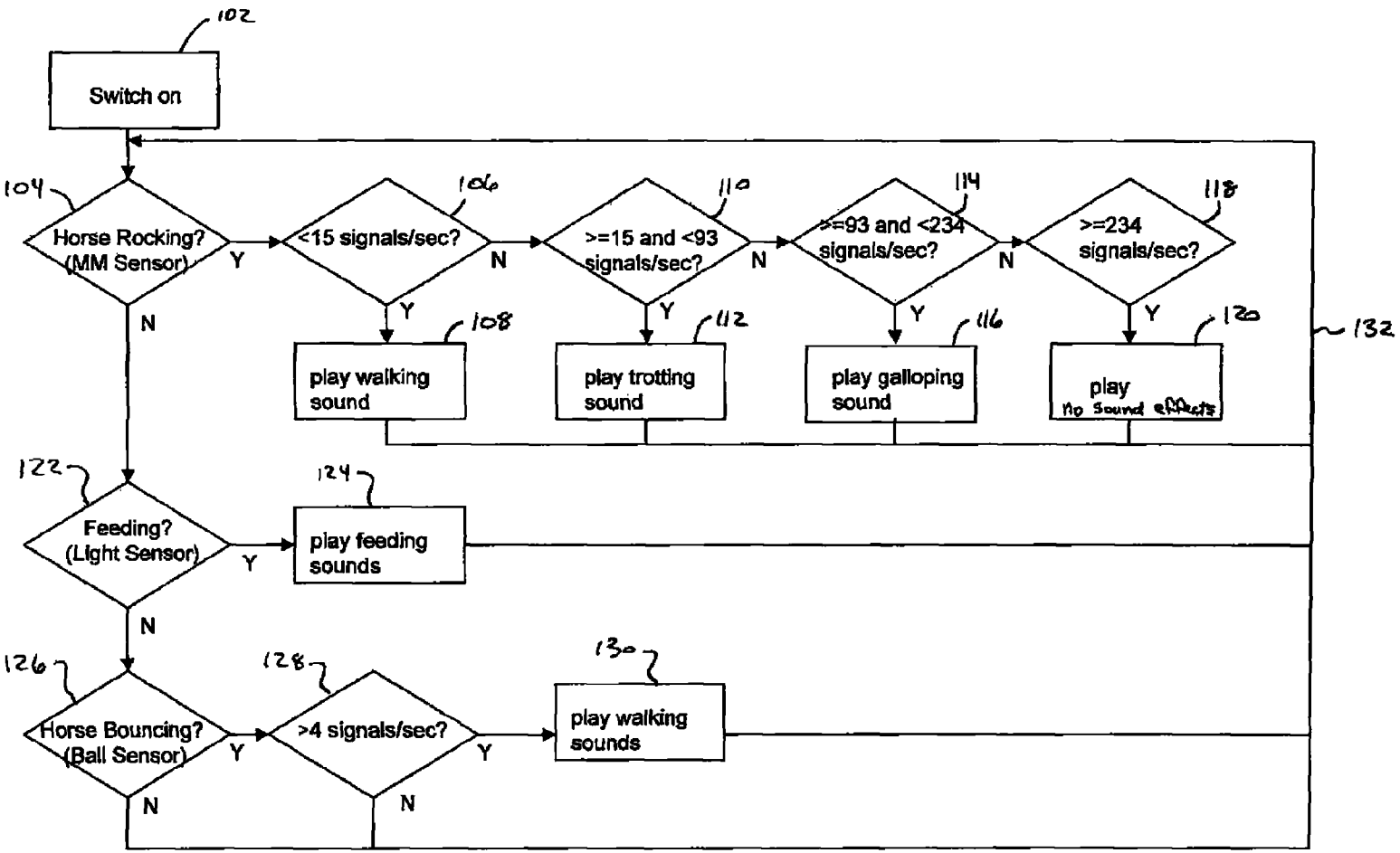
FIG. 5 is a flow chart illustrating the logic performed by the microcontroller of the electronics module of FIGS. 2-4B during operation of the electronics of the children's riding toy of FIGS. 1-4B.

As indicated at 104 in FIG. 5, the microcontroller first checks for rocking motion via the main motion sensor 44 of FIGS. 2 and 3. If the riding toy is being ridden so as to provide a rocking motion of the horse body with respect to the base (and a surface upon which the base is supported), the microcontroller will receive greater than zero signals per second from the main motion sensor. As indicated at 106 in FIG. 5, the microcontroller then checks if the speed of the rocking motion is such that the main motion sensor is providing less than 15 signals/second to the microcontroller. If so, as indicated by block 108, the microcontroller triggers the sound synthesizing circuit (54 in FIG. 3) to play a horse walking sound effect through the electronics module speaker (64 in FIG. 3), that is, the sound made by hooves when a horse is walking on a surface.

If the speed of rocking motion is not less than 15 signals per second (signals/second), the microprocessor checks if the speed is greater than or equal to (>=) 15 signals/second or less than 93 signals/second, as indicated at 110 in FIG. 5. If the speed of rocking motion causes the main motion sensor to provide signals to the microcontroller at a rate in this range (>=15 signals/second and <93 signals/second), then, as illustrated by block 112, the microcontroller triggers the sound synthesizer circuit to play a horse trotting sound effect through the speaker.

If the speed of rocking motion is not in the range of >=15 signals/second and <93 signals/second, the microprocessor checks if the speed is >=93 signals/second and <234 signals/second, as indicated at 114 in FIG. 5. If the speed of rocking motion causes the main motion sensor to provide signals to the microcontroller at a rate in this range (>=93 signals/second and <234 signals/second), then, as illustrated by block 116, the microcontroller triggers the sound synthesizer circuit to play a horse galloping sound effect through the speaker.

If the speed of rocking motion is not in the range of >=93 signals/second and <234 signals/second, the microprocessor checks if the speed is >=234 signals/second, as indicated at 118 in FIG. 5. If the speed of rocking motion causes the main motion sensor to provide signals to the microcontroller at a rate >=234 signals/second, then, as illustrated by block 120, the microcontroller signals the sound synthesizer circuit to eliminate all sound effects. Alternatively, the microcontroller can be programmed to signal or activate the sound synthesizer circuit to play a music sound effect through the speaker.

Of course alternative sound effects may be substituted for those described above and illustrated in FIG. 5.

Returning to 104 in FIG. 5, if the child user is not riding the toy so as to produce a rocking motion, the microcontroller checks to see if the light sensor 82 of FIG. 3 has been activated, as indicated at 122. More specifically, as described previously and indicated in FIGS. 3 and 4A, the light sensor 82 is mounted in a light sensor tube 74 having a bottom 76 featuring an opening 78. With reference to FIG. 4A, a child user can simulate feeding the horse riding toy by inserting an item, such as artificial carrot 85, into the simulated mouth 72 of the horse such that the opening 78 of the light sensor tube 74 is covered. With reference to FIG. 3, this causes the interior 84 of the light sensor tube 74 to become dark. As a result, light sensor 82 is triggered and it sends a signal to microcontroller 52 which in turn signals or activates the sound synthesizer circuit 54 to play crunching, munching and chomping sounds, "Neigh!" sounds, or other sound effects that relate to a horse being fed, through the speaker 64 (FIG. 3). This is indicated by block 124 of FIG. 5.

If the main motion sensor and light sensor have not been activated at 104 and 122 in FIG. 5, respectively, as indicated at 126 in FIG. 5, the microcontroller checks if the horse is being ridden so as to produce a bouncing motion. More specifically, the microcontroller detects that the horse is being ridden in such a manner so as to provide a bouncing motion when it receives signals from the ball sensor (46 in FIGS. 2 and 3). If the microcontroller detects that bouncing motion is present, it checks if the speed of the bouncing motion, as detected by the ball sensor, is greater than 4 signals/second, as indicated at 128 in FIG. 5. If the speed of the bouncing motion exceeds this threshold, the microcontroller triggers the sound synthesizing circuit to play a horse walking sound effect through the electronics module speaker, as indicated by block 130.

The microcontroller is programmed so that activation of any of the sound effects of blocks 108, 112, 116, 120, 124 and 130 of FIG. 5 preempts the previously activated sound effect. As indicated by line 132 in FIG. 5, after each sound effect is triggered (blocks 108, 112, 116, 120, 124 and 130), microcontroller processing loops back to the start of the flow chart of FIG. 5 to check if any of the three sensors have been activated or deactivated. The hierarchy arrangement of the main motion sensor, light sensor and ball sensor (at 104, 122 and 126, respectively) in the flow chart of FIG. 5 means that the sensors will preempt one another with the following priority:

Main Motion Sensor (Walk, Trot Gallop, Music)—highest priority

Light Sensor (Feed)—middle priority

Ball Sensor (Walk)—lowest priority

As a result, if, for example, the light sensor has been activated so that feeding sound effects are being produced (122 and 124 in FIG. 5), and then a child begins riding the horse so that a rocking motion is produced, the feeding sound effects will stop and either a walking, trotting, galloping or music sound effect will play (blocks 108, 112, 116 or 120) based on the speed of the rocking motion as described above. As another example, if the horse is being ridden in a bouncing motion at a speed sufficient to produce walking sound effects (126, 128 and 130 in FIG. 5), and then the rider starts rocking the horse so as to produce a rocking motion, then the walking sound effect will stop and either the walking, trotting, galloping or music sound effect will play based on the speed of the rocking motion.

By providing various sound effects based upon the speed of the child user's rocking motion, the embodiment of the riding toy of the invention described above motivates the child to rock faster. In addition, the riding toy provides various interactive play features for activities related to riding (rocking and bouncing) or activities other than riding (such as simulated feeding). This increases the child's interest in and enjoyment of the riding toy. In addition, the modular construction of the electronics module permits it to be easily removed from the body of the horse for replacement or repair.

It should be noted that while the embodiment of the present invention has been described above with regard to rocking and bouncing motions, other types of motions could be substituted and are within the scope of the present invention.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A riding toy comprising:

a body having a seat area adapted to support a child;

a support assembly supporting the body so that the body may be moved in a first type of motion and a second type of motion, the second type of motion being distinct from the first type of motion;

a motion sensor responsive to at least one of the first and second types of motions, said motion sensor positioned on the body;

a speaker on the body; and, a microcontroller programmed to have a first sound effect produced by the speaker when the motion sensor detects the first type of motion and a second sound effect produced by the speaker when the motion sensor detects the second type of motion, the second sound effect being different than the first sound effect.

2. The riding toy of claim 1, wherein the motion sensor comprises a first motion sensor responsive to the first type of motion and a second motion sensor responsive to the second type of motion, said first and second motion sensors positioned on the body and in electronic communication with the microcontroller.

3. The riding toy of claim 2, wherein the microcontroller is programmed to have a first sound effect produced by the speaker when the first motion sensor detects the first type of motion, and a second sound effect produced by the speaker when the second motion sensor detects the second type of motion.

4. The riding toy of claim 2, wherein the first and second sensors are different types of sensors.

5. The riding toy of claim 2, wherein the first type of motion is a rocking motion and the second type of motion is a bouncing motion.

6. The riding toy of claim 5, wherein the second motion sensor is a ball sensor.

7. The riding toy of claim 1, wherein the microcontroller is programmed to vary the first sound effect produced by the speaker based on a speed of the first type of motion.

8. The riding toy of claim 1, wherein the microcontroller is programmed to preempt the second sound effect if both the first and second types of motions take place simultaneously.

9. The riding toy of claim 1, further comprising a sound synthesizing circuit in electronic communication with the microcontroller and the speaker.

10. The riding toy of claim 1 wherein the microcontroller and speaker are part of an electronics module removably mounted within the body of the riding toy.

11. The riding toy of claim 10, wherein the motion sensor is part of the electronics module.

12. The riding toy of claim 1, further comprising a light sensor in electronic communication with the microcontroller, the microcontroller having the speaker produce a different sound effect when the light sensor is triggered.

13. The riding toy of claim 12, wherein the light sensor is mounted within the body of the riding toy adjacent an opening, said light sensor being triggered when an object covers the opening.

14. The riding toy of claim 1, wherein the first sound effect includes a walking sound that is produced by the speaker in response to a signal by the microcontroller when the sensor senses the first type of motion at a speed below a first threshold, wherein the first sound effect includes a trotting sound that is produced by the speaker in response to a signal by the microcontroller when the sensor senses the first type of motion at a speed at or above the first threshold but below a second threshold, and wherein the speaker produces a galloping sound in response to a signal by the microcontroller when the sensor senses the first type of motion at a speed at or above the second threshold.

15. A riding toy comprising:

a body having a seat area adapted to support a child;

a support assembly supporting the body so that the body may be moved in a first type of motion and a second type of motion;

a first motion sensor positioned on the body, the first motion sensor responsive to a range of speeds of movement of the first type of motion;

a speaker on the body; and, a microcontroller in electrical communication with the first motion sensor and programmed to have a first sound effect produced by the speaker when the first motion sensor detects the first type of motion at a speed below a first threshold, the microcontroller programmed to have a second sound effect produced by the speaker when the first motion sensor detects the first type of motion at a speed at or above the first threshold but below a second threshold.

16. The riding toy of claim 15, wherein the microcontroller is programmed to have a third sound effect produced by the speaker when the first motion sensor detects the first type of motion at a speed at or above the second threshold but below a third threshold.

17. The riding toy of claim 15, further comprising a second motion sensor responsive to a range of speeds of movement of a second type of motion, and to have a sound effect produced by the speaker when the second sensor detects the second type of motion at a speed above a first threshold for the second motion sensor.

18. A riding toy comprising:

a body having a seat area adapted to support a child;

a support assembly supporting the body so that the body may be moved in a first type of motion and a second type of motion;

a first motion sensor positioned on the body, the first motion sensor responsive to a range of speeds of movement of the first type of motion;

a speaker on the body;

a light sensor mounted within the body of the riding toy adjacent an opening, said light sensor being triggered when an object covers the opening of the light sensor; and, a microcontroller in electrical communication with the first motion sensor and programmed to have a first sound effect produced by the speaker when the first motion sensor detects the first type of motion, the microcontroller also being in electrical communication with the light sensor and programmed to have a different sound effect produced by the speaker when the light sensor is triggered.

* * * * *